US005366125A

United States Patent [19]

Procido

[11] Patent Number: 5,366,125

[45] Date of Patent: Nov. 22, 1994

[54] SOAP CONTAINER AND SUPPORT

[76] Inventor: Frieda Procido, 5379 Evening Star Way, Lake Worth, Fla. 33467

[21] Appl. No.: 196,694

[22] Filed: Feb. 15, 1994

[51] Int. Cl.[5] ..... A45F 3/02; A47K 7/02; A47K 5/08

[52] U.S. Cl. ..... 224/202; 224/257; 224/254; 401/201; 206/77.1; 383/117

[58] Field of Search ..... 224/254, 257, 258, 202, 224/191, 207, 205; 206/77.1, 210; 383/117, 71, 43, 118; 401/201

[56] References Cited

U.S. PATENT DOCUMENTS

| | | | |
|---|---|---|---|
| 2,817,865 | 12/1957 | Arioli | 401/201 |
| 3,124,827 | 3/1964 | Hull | 401/201 |
| 3,206,152 | 9/1965 | Wimmer | 401/201 |
| 3,251,571 | 5/1966 | Ernst . | |
| 3,326,430 | 6/1967 | Banks | 224/254 |
| 3,377,121 | 4/1968 | Billesbach et al. | 206/77.1 |
| 4,069,955 | 1/1978 | Noyes . | |
| 4,228,834 | 10/1980 | Desnick | 383/117 |
| 4,480,939 | 11/1984 | Upton | 401/201 |
| 4,898,311 | 2/1990 | Boyer | 224/257 |
| 4,966,319 | 10/1990 | Fleming | 224/207 |
| 5,022,517 | 6/1991 | Benitez | 206/77.1 |
| 5,031,759 | 7/1991 | Ogilvie | 206/77.1 |
| 5,033,613 | 7/1991 | Liggett | 206/77.1 |
| 5,092,682 | 3/1992 | Fenick | 383/117 |
| 5,178,311 | 1/1993 | McBride | 224/257 |
| 5,207,725 | 5/1993 | Pinkerton | 383/117 |
| 5,244,135 | 9/1993 | Nelson | 224/202 |
| 5,255,833 | 10/1993 | McAllister | 224/202 |

FOREIGN PATENT DOCUMENTS

| | | | |
|---|---|---|---|
| 145889 | 5/1936 | Austria | 224/207 |
| 2498926 | 8/1982 | France | 401/201 |
| 838381 | 6/1960 | United Kingdom | 401/201 |

*Primary Examiner*—Henry J. Recla
*Assistant Examiner*—Gregory M. Vidovich
*Attorney, Agent, or Firm*—Malin, Haley, DiMaggio & Crosby

[57] ABSTRACT

A soap dispenser and support combination to be worn around a person's neck to allow dispensing of soap over the person's entire body. The combination includes a mesh soap container having an opening in a top surface thereof, the top surface opening being bordered by elastic for insertion and removal of soap. A stretchable strap formed in a partial loop is attached to the soap container. The strap has a sufficient stretchability so that the person can grasp the soap container and stretch the strap while the strap remains around the neck of the person and touch any portion of the person's body with the soap container.

18 Claims, 3 Drawing Sheets

SOAP CONTAINER AND SUPPORT

BACKGROUND OF THE INVENTION

1. Field of the Invention

This invention relates to a soap container and support combination for a soap bar or soap chips or remnants bound in a sack dispenser that is hung around the body for use in showering. More particularly, the present invention relates to a bar soap container made of a particular dispensing material for holding the bar of soap while dispensing soap therethrough, mounted on an extendable, stretchable strap support that is hung about the neck of a person so that the soap dispensing sack can be stretched to contact any part of the body without removing the strap from the neck of the person.

2. Description of the Prior Art

The use of a bar of soap that is firmly attached to a loop, which is traditionally a rope, connected and mounted about the neck of the wearer for use in the shower is well known. The purpose is, of course, to prevent dropping the soap while showering. The primary disadvantage of such a bar of soap is that the rope is not longitudinally elastic so that it cannot be stretched, but remains in a fixed position. Therefore, in order to utilize the soap, the soap bar must either first be contacted and then the soap transferred by hand to other portions of the body, or the rope must be removed from the wearer's neck so that the soap bar can contact the unreachable portions of the wearer's body. Direct contact with soap on all parts of the user's body is not possible because of the inflexible nature of the loop extension. Another drawback is that the bar of soap is permanently mounted to the rope and therefore, once the bar of soap is expended, the rope is then discarded. An example of a soap holder and adjustable loop is shown in U.S. Pat. No. 3,251,571 issued to F. Ernest on May 17, 1966. Bars of soap can be inserted and utilized with the adjustable loop provided in the rope. However, the loop is fixed in length and cannot be stretched for direct application of soap to any part of the body. U.S. Pat. No. 5,031,759 issued to Ogilvie on Jul. 16, 1991, shows a water-pervious bag for holding a bar of soap while washing a person's body; the bag being comprised of a wide, loose weave. The loop is used to close the bag. No provision is made for supporting the bag and hanging it on the body of the wearer. Therefore, the primary drawback to the inventions as disclosed is that although soap has been supported on a fixed loop around the neck of the wearer, it is not easily usable for stretching to reach all areas of the body during its use.

The present invention overcomes these shortcomings by providing a soap dispenser that can be mounted on and around the neck of the user to allow dispensing of soap all over the entire body while taking a shower. The soap dispenser comprises a soap container which houses a bar of soap or soap chips or a liquid soap dispenser, and a stretchable, elastic strap formed in a partial loop that is connected to the soap container, wherein the user can grasp the soap container and stretch the elastic strap while it still remains around the neck of the user to touch any portion of the human body, including the feet, with the soap container.

SUMMARY OF THE INVENTION

A body soap dispenser that can be mounted on and around the neck of the user to allow dispensing of soap all over the entire body while taking a shower. The soap dispenser comprises a soap container which includes a resilient, pliable, water pervious material in the form of a small mesh sack to receive a standard bar of soap, and a stretchable, elastic strap formed in a partial loop that is connected to the small mesh sack containing the soap. The periphery of the elastic strap loop is such that in an unstretched or relaxed position, the loop is formed to mount around the neck of the person and droop by gravity to the midfront abdominal portion of the user. However, the elastic strap is such that it has sufficient elasticity and stretchability that one can manually grasp the small sack containing the soap, apply manual force, and stretch the elastic strap while it still remains around the neck of the user to touch any portion of the human body, including the feet, with the small sack itself, allowing for soap to be dispensed. The loop can also be adjusted laterally and longitudinally through manual movement so that the user can contact other areas of the body with the small sack without removing the loop from around the user's neck.

The mesh sack may be made of nylon and cotton fabric woven together so that water and soap can pass through in both directions, allowing the soap to be activated, and allowing for a scrubbing action with the sack material itself against the body, with the soap being fed therethrough. The ends of the elastic strap are firmly attached by sewing or other convenient fasteners to firmly hold the small sack to the elastic strap at each end of the elastic strap. The sack has an opening in its top surface that may be overlapped so that once the bar of soap is inserted, it can not accidentally fall out. For example, the sack may have an opening in its top surface bordered by elastic such that once the opening or mouth of the sack is opened and a bar of soap inserted, the elastic "rebounds" to its original position, thereby preventing the bar of soap from accidentally falling out of the sack. The interior cavity of the sack would be sized and shaped to receive a standard size bar of soap.

In an alternate embodiment, liquid soap may be utilized in the soap dispenser described above, wherein the liquid soap is housed in a standard liquid soap container with a spout. As described above, the mesh sack is attached to an elastic strap by sewing or other convenient fasteners to firmly hold the strap to the sack so that liquid soap could be dispensed on any pare of the body by stretching the elastic strap and tilting the dispenser in an appropriate direction.

The device can be efficiently manufactured at low cost and is, therefore, reusable for bar soap or liquid soap. The device can also be used with the small, mesh sack to collect soap remnants, which are small pieces of soap, in a group so that the soap gets completely used up and is not wasted.

It is an object of this invention to provide an improved bar soap and body soap dispenser for use in a shower that allows for direct contact on the user's body from any position without dropping the soap in the shower so that the user will not have to bend over to pick up the soap.

It is another object of this invention to provide a soap bar support that is attached around the neck of the user that allows for manual stretching and positioning of the soap sack or dispenser to any location of the body.

It is another object of this invention to provide a support for a bar of soap that has an elastic cord that can be stretched along its longitudinal axis and has memory to return to its original position once the force is retracted so that a bar of soap can be supported around the neck of the user.

And yet another object of this invention is to provide a soap holder for use in the shower that prevents the soap from being dropped to make a safer environment for the user.

In accordance with these and other objects which will become apparent hereinafter, the instant invention will now be described with particular reference to the accompanying drawings.

DESCRIPTION OF THE PREFERRED EMBODIMENTS

Figure 1:
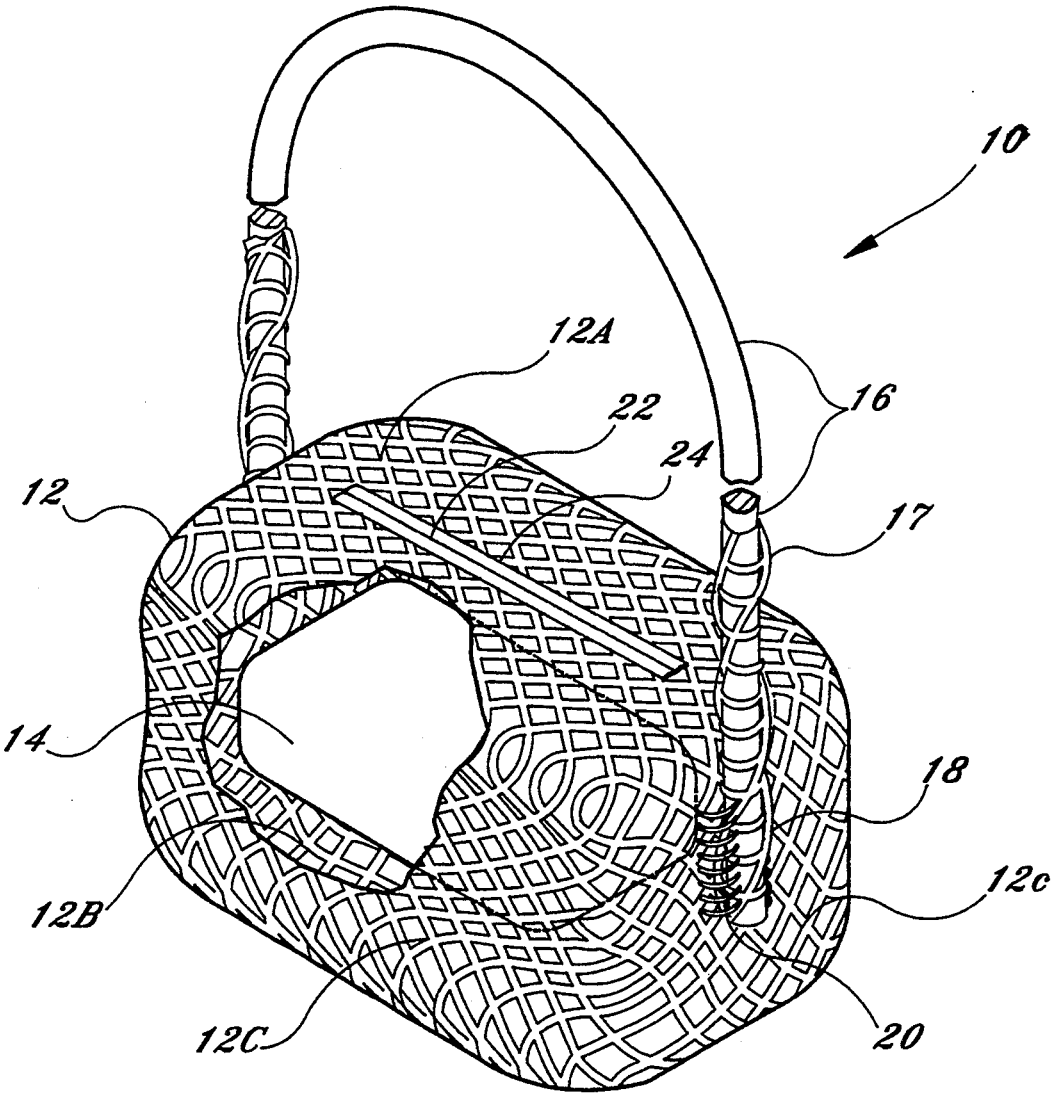
FIG. 1 shows a perspective view, partially cut away, of the instant invention.
Figure 2:
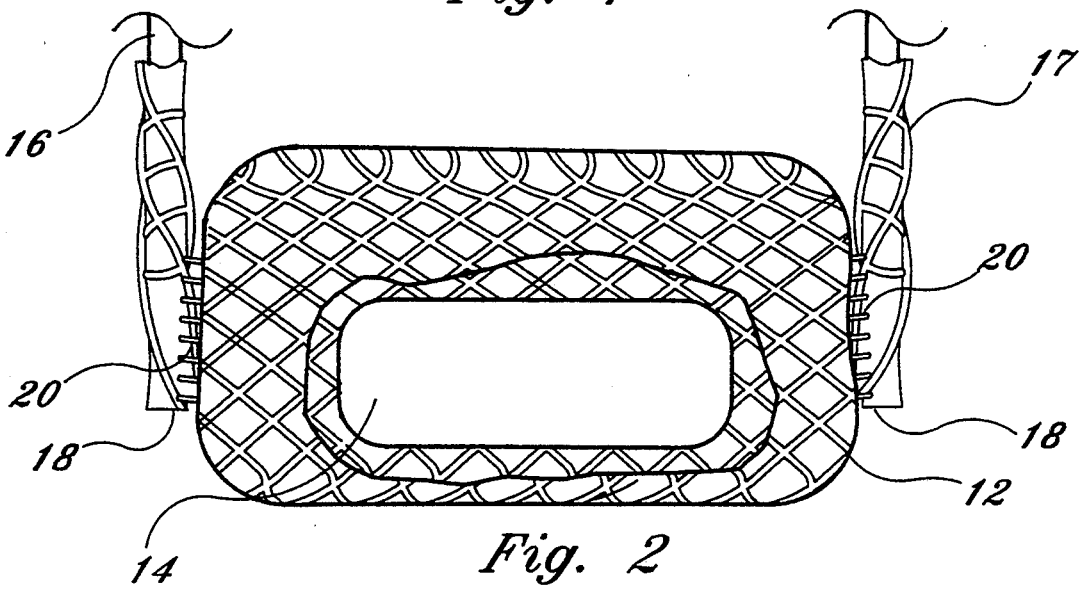
FIG. 2 shows a front elevational view, partially cut away, of the invention in cross section.
Figure 3:
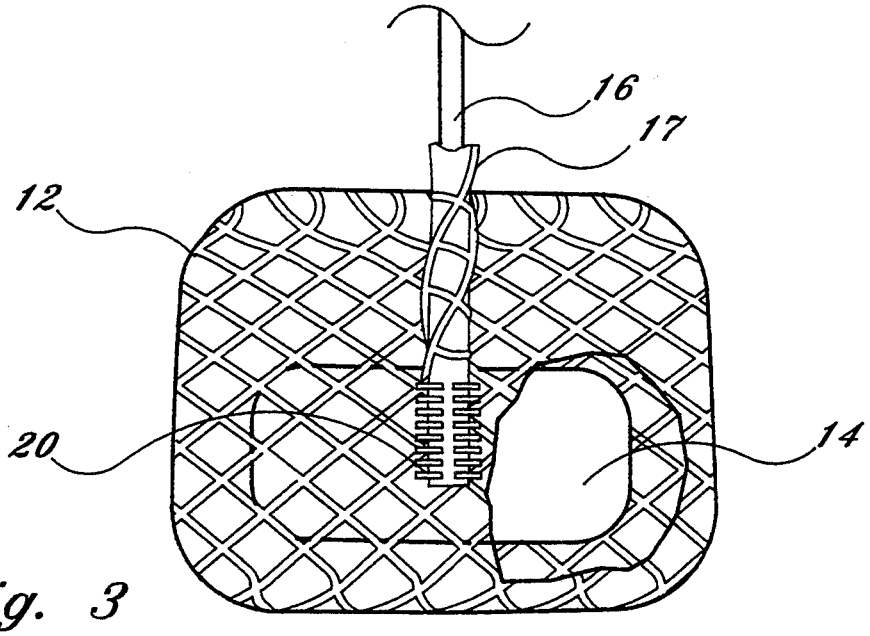
FIG. 3 shows a side elevational view, partially cut away, of the invention.

With reference to the drawings, FIGS. 1–3 depict a soap dispenser and support combination generally indicated by the reference numeral 10, comprising a soap container 12, a bar of soap 14, and an elastic strap 16. The soap container 12 is a mesh sack made of nylon and cotton fabric woven together so that water and soap can pass through in both directions, allowing the soap to be activated, and allowing for a scrubbing action with the sack material itself against a person's body, with the soap being fed therethrough. Preferably, soap container 12 is in the form of spider mesh fabric having holes approximately ⅛ of an inch wide. Soap container 12 has a top surface 12A, a bottom surface 12B, and a plurality of side surfaces 12C. Soap container 12 has an opening 22 in top surface 12A to receive a standard bar of soap 14. Top surface opening 22 is bordered around its perimeter by elastic 24 such that once the opening 22 or mouth of the container 12 is opened and a bar of soap inserted, the elastic 24 "rebounds" to its original position, thereby preventing the bar of soap 14 from accidentally falling out of the container 12. The interior cavity of the container is sized and shaped to receive a standard size bar of soap.

A stretchable, laterally and longitudinally elastic strap 16 formed in a partial loop is connected to soap container 12. Elastic strap 16 may be in the form of ⅛ of an inch wide braided elastic or the like. Elastic strap 16 is covered by a fabric cover 17 to protect the person's neck from chafing. The fabric cover 17 is attached to strap 16 at strap ends 18. Elastic strap 16 is connected at its ends 18 by sewing or other convenient fasteners 20 to soap container 12 to firmly hold container 12 to elastic strap 16 at each end. The length of the elastic strap 16 is such that in an unstretched position, the loop may be formed to mount around the neck of the person and droop by gravity to the mid-front abdominal portion of the person. However, the elastic strap is such that it has sufficient elasticity and stretchability that one could manually grasp the soap container 12, apply a manual force, and stretch the elastic strap 16 while it still remains around the neck of the person to touch any portion of the human body, including the feet, with the soap container 12 itself. Typical dimensions for soap container 12 may be five (5) inches in length by three (3) inches in width by five (5) inches in height. Opening 22 in the top of container 12 may be one-and-a half (1.5) inches long when at rest and may expand to four inches long when the elastic 24 surrounding the opening 22 is stretched. Typical dimensions for elastic strap 16 may be twenty (20) inches when strap 16 is at rest and forty (40) inches when strap 16 is stretched.

Figure 4:
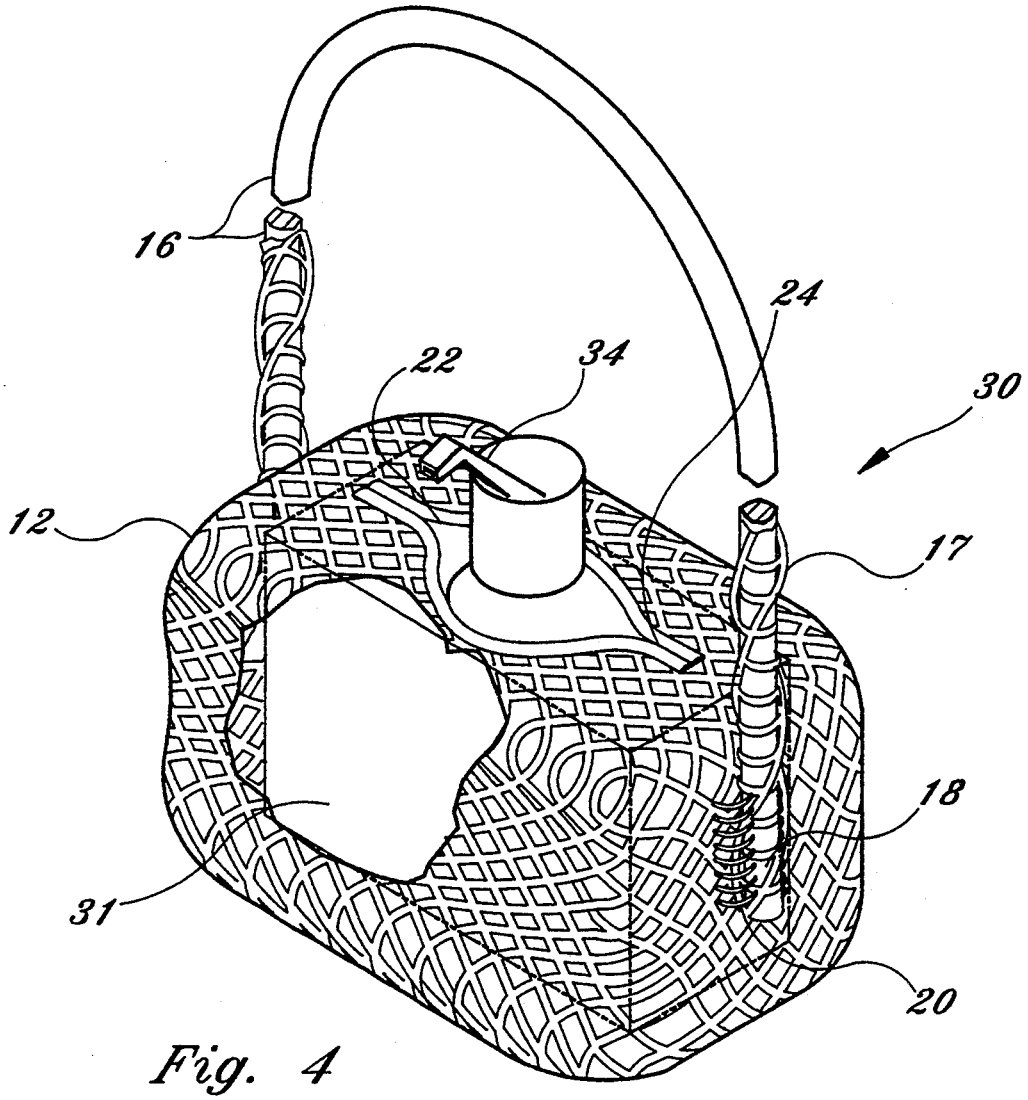
FIG. 4 shows a perspective view, partially cut away, of an alternate embodiment of the invention using a liquid soap dispenser.

An alternate embodiment is shown in FIG. 4, wherein liquid soap is utilized in the soap dispenser described above. As seen in FIG. 4, a liquid soap dispenser and support combination is generally indicated by the reference numeral 30, comprising a liquid soap housing 31 having a spout 34, disposed within soap container 12 as described above. Soap container 12 is in the form of a mesh sack made of nylon and cotton fabric woven together. Elastic strap 16 is connected at its ends 18 by sewing or other convenient fasteners 20 to soap container 12 to firmly hold container 12 to elastic strap 16 at each end. As described above, soap container 12 has an opening 22 in its top surface, wherein top surface opening 22 is bordered by elastic 24 such that liquid soap housing 31 may be received by soap container 12 and securely held therein when the elastic 24 about opening 22 rebounds and returns to its relaxed position. The interior cavity of the soap container 12 is sized and shaped to receive a standard liquid soap housing.

Figure 5:
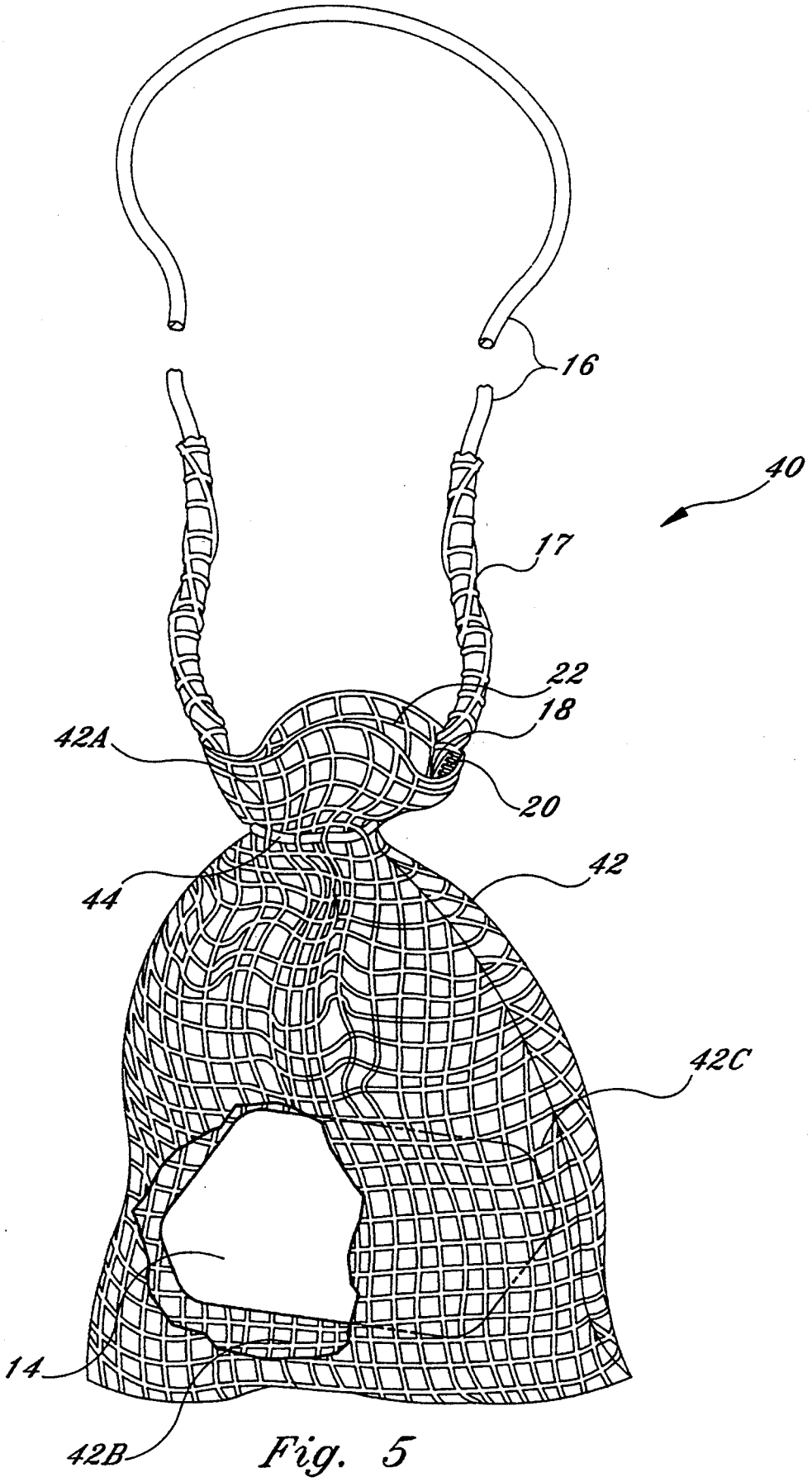
FIG. 5 shows a perspective view, partially cut away, of yet another alternate embodiment of the instant invention.

Referring to FIG. 5, another alternate embodiment is shown, wherein a soap dispenser and support combination generally indicated by the reference numeral 40, comprises a soap container 42, a bar of soap 14, and an elastic strap 16. As described above, the soap container 42 is a mesh sack made of nylon and cotton fabric woven together so that water and soap can pass through in both directions, allowing the soap to be activated, and allowing for a scrubbing action with the sack material itself against a person's body, with the soap being fed therethrough. Preferably, soap container 42 is in the form of spider mesh fabric having holes approximately ⅛ of an inch wide. Soap container 42 has a top surface 42A, a bottom surface 42B, and a plurality of side surfaces 42C. Soap container 42 has an opening 22 in top surface 42A to receive a standard bar of soap 14. An elastic ring 44 is disposed proximal the top surface opening 22, thereby providing a releasable closing means for the open end of the soap container 42, such that once the opening 22 or mouth of the container 42 is opened and a bar of soap inserted, the elastic 44 "rebounds" to its original position, thereby preventing the bar of soap 14 from accidentally falling out of the container 42. The interior cavity of the container is sized and shaped to receive either a standard size bar of soap or a standard liquid soap housing.

As described above, a stretchable, laterally and longitudinally elastic strap 16 formed in a partial loop is connected to soap container 42. Elastic strap 16 may be in the form of ⅛ inch wide braided elastic or the like. Elastic strap 16 is covered by a fabric cover 17 to protect the person's neck from chafing. The fabric cover 17 is attached to strap 16 at strap ends 18. Elastic strap 16 is connected at its ends 18 by sewing or other convenient fasteners 20 to soap container 42 to firmly hold container 42 to elastic strap 16 at each end. The length of the elastic strap 16 is such that in an unstretched position, the loop may be formed to mount around the neck of the person and droop by gravity to the midfront abdominal portion of the person. However, the elastic strap is such that it has sufficient elasticity and stretchability that one could manually grasp the soap container 42, apply a manual force, and stretch the elastic strap 16 while it still remains around the neck of the person to touch any portion of the human body, including the feet, with the soap container 42 itself.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A soap container and support combination to be worn around a person's neck for washing a person's body, comprising:

a receptacle for containing soap, said receptacle comprising a resilient, pliable, water pervious material, said receptacle having a top surface, a bottom surface, and a plurality of side surfaces, said top surface having an opening therein, said top surface opening having a perimeter, said top surface opening further having a means for releasably closing said top surface opening disposed around said top surface opening perimeter; and a stretchable strap having two ends, said strap having a predetermined length when said strap is in a relaxed, non-stretched position, said strap fixedly attached to said receptacle at each of said strap ends, forming a partial loop, said strap having a sufficient stretchability so that the person can grasp said receptacle, apply manual force, and stretch said strap while said strap remains around the neck of the person and touch any portion of the person's body with said receptacle, thereby allowing the person to contact other areas of the person's body with the receptacle without removing the strap from around the person's neck.

2. The combination recited in claim 1, further comprising a bar of soap disposed within said receptacle.

3. The combination recited in claim 1, further comprising a liquid soap dispenser disposed within said receptacle.

4. The combination recited in claim 1, wherein said means for releasably closing comprises elastic.

5. The combination recited in claim 1, wherein said receptacle material comprises a nylon and cotton weave.

6. The combination recited in claim 1, wherein said stretchable strap has a non-abrasive cover thereabout.

7. The combination recited in claim 2, wherein said receptacle permits water and soap to pass therethrough, allowing the bar of soap to be activated, and further allowing for a scrubbing action with the receptacle material against the person's body with the soap being fed therethrough.

8. The combination recited in claim 3, wherein said receptacle allows water and soap to pass therethrough, allowing for a scrubbing action with the receptacle material against the person's body.

9. A soap container and support combination to be worn around a person's neck for washing a person's body, comprising:

a bar of soap;

a receptacle for containing said bar of soap, said receptacle comprising a resilient, pliable, water pervious material, said receptacle having a top surface, a bottom surface, and a plurality of side surfaces, said top surface having an opening therein for insertion and removal of said bar of soap, said top surface opening having a perimeter, said top surface opening having elastic disposed around its perimeter for releasably closing said top surface opening; and a stretchable strap having two ends, said strap having a predetermined length when said strap is in a relaxed, nonstretched position, said strap fixedly attached to said receptacle at each of said strap ends, said strap forming a partial loop having a periphery large enough so that said strap is able to be worn around the neck of the person, said strap having a sufficient stretchability so that the person can grasp said receptacle, apply manual force, and stretch said strap while said strap remains around the neck of the person and touch any portion of the person's body with said receptacle, thereby allowing the person to contact other areas of the person's body with the receptacle without removing the strap from around the person's neck while allowing soap to be dispensed.

10. The combination recited in claim 9, wherein said stretchable strap has a non-abrasive cover thereabout.

11. The combination recited in claim 9, wherein said receptacle material comprises a nylon and cotton weave.

12. The combination recited in claim 11, wherein said receptacle permits water and soap to pass therethrough, allowing the bar of soap to be activated, and allowing for a scrubbing action with the receptacle material against the person's body with the soap being fed therethrough.

13. A soap container and support combination to be worn around a person's neck for washing a person's body, comprising:

a receptacle for containing soap, said receptacle comprising a resilient, pliable, water pervious material, said receptacle being closed at one end and open at another end, said receptacle having releasable closing means proximal said another end; and a stretchable strap having two ends, said strap having a predetermined length when said strap is in a relaxed, nonstretched position, said strap fixedly attached to said receptacle at each of said strap ends, forming a partial loop, said strap having a sufficient stretchability so that the person can grasp said receptacle, apply manual force, and stretch said strap while said strap remains around the neck of the person and touch any portion of the person's body with said receptacle, thereby allowing the person to contact other areas of the person's body with the receptacle without removing the strap from around the person's neck.

14. The combination recited in claim 13, further comprising a bar of soap disposed within said receptacle.

15. The combination recited in claim 13, wherein said releasable closing means comprises elastic.

16. The combination recited in claim 13, wherein said receptacle material comprises a nylon and cotton weave.

17. The combination recited in claim 13, wherein said stretchable strap has a non-abrasive cover thereabout.

18. The combination recited in claim 14, wherein said receptacle permits water and soap to pass therethrough, allowing the bar of soap to be activated, and further allowing for a scrubbing action with the receptacle material against the person's body with the soap being fed therethrough.

* * * * *